US010844856B2

(12) United States Patent
Yosuke et al.

(10) Patent No.: US 10,844,856 B2
(45) Date of Patent: Nov. 24, 2020

(54) SCROLL COMPRESSOR

(71) Applicant: DAIKIN INDUSTRIES, LTD., Osaka-shi, Osaka (JP)

(72) Inventors: Yoshinobu Yosuke, Osaka (JP); Yongsheng Zhao, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 16/328,073

(22) PCT Filed: Jun. 28, 2017

(86) PCT No.: PCT/JP2017/023763
§ 371 (c)(1),
(2) Date: Feb. 25, 2019

(87) PCT Pub. No.: WO2018/042852
PCT Pub. Date: Mar. 8, 2018

(65) Prior Publication Data

US 2019/0178248 A1 Jun. 13, 2019

(30) Foreign Application Priority Data

Aug. 31, 2016 (JP) ..... 2016-169770

(51) Int. Cl.
*F04C 18/02* (2006.01)
*F04C 29/00* (2006.01)
*F04C 27/00* (2006.01)
*F04C 23/00* (2006.01)

(52) U.S. Cl.
CPC ..... *F04C 18/0215* (2013.01); *F04C 18/02* (2013.01); *F04C 18/0246* (2013.01);
(Continued)

(58) Field of Classification Search
CPC .. F04C 18/02; F04C 18/0215; F04C 18/0246; F04C 18/0261; F04C 2240/30;
(Continued)

(56) References Cited

U.S. PATENT DOCUMENTS 6,217,302 B1 * 4/2001 Sun ..... F04C 27/005 418/55.4
6,389,837 B1 * 5/2002 Morozumi ..... F04C 23/008 418/55.5
(Continued)

FOREIGN PATENT DOCUMENTS

CN 101761477 A 6/2010
JP 2001-227480 A 8/2001
(Continued)

OTHER PUBLICATIONS

European Search Report of corresponding EP Application No. 17 84 5862.6 dated May 8, 2019.
(Continued)

*Primary Examiner* — Patrick Hamo
*Assistant Examiner* — Paul W Thiede
(74) *Attorney, Agent, or Firm* — Global IP Counselors, LLP

(57) ABSTRACT

A scroll compressor includes a compression mechanism having fixed and movable scrolls forming a compression chamber, a motor to drive the movable scroll, a casing accommodating the compression mechanism and the motor, a housing accommodated inside the casing, a floating member supported by the housing, a first seal member, and first and second flow passages. An inside of the casing is partitioned into first and second spaces. The floater member can be pushed toward the movable scroll by pressure in a back-pressure space formed between the floating member and the housing. The first seal partitions the back-pressure
(Continued)

space into first and second chambers. The first flow passage guides the refrigerant in the middle of compression in the compression mechanism to the first chamber. The second guides the refrigerant discharged from the compression mechanism to the second chamber.

13 Claims, 4 Drawing Sheets

(52) U.S. Cl.
CPC ..... *F04C 18/0261* (2013.01); *F04C 23/008* (2013.01); *F04C 27/005* (2013.01); *F04C 27/008* (2013.01); *F04C 29/0021* (2013.01); *F04C 2240/30* (2013.01); *F04C 2240/60* (2013.01); *F05B 2210/14* (2013.01)

(58) Field of Classification Search
CPC .. F04C 2240/60; F04C 23/008; F04C 27/005; F04C 27/008; F04C 29/0021; F05B 2210/14
USPC ..... 418/55.1, 55.2, 55.3, 55.4, 55.5, 55.6, 418/205, 107; 417/410.5, 228, 360
See application file for complete search history.

(56) References Cited

U.S. PATENT DOCUMENTS

2003/0156961 A1* 8/2003 Iizuka ..... F04C 27/005 418/55.3
2006/0263225 A1* 11/2006 Ueda ..... F04C 27/005 418/55.5
2016/0040671 A1* 2/2016 Choi ..... F04C 29/0057 418/55.1
2019/0186489 A1* 6/2019 Yosuke ..... F04C 18/0215

FOREIGN PATENT DOCUMENTS

JP 2006-322421 A 11/2006
JP 2013-167215 A 8/2013

OTHER PUBLICATIONS

International Preliminary Report of corresponding PCT Application No. PCT/JP2017/023763 dated Mar. 14, 2019.
International Search Report of corresponding PCT Application No. PCT/JP2017/023763 dated Aug. 8, 2017.

* cited by examiner

SCROLL COMPRESSOR

CROSS-REFERENCE TO RELATED APPLICATIONS

This U.S. National stage application claims priority under 33 U.S.C. § 119(a) to Japanese Patent Application No. 2016-169770, filed in Japan on Aug. 31, 2016, the entire contents of which are hereby incorporated herein by reference.

TECHNICAL FIELD

The present invention relates to a scroll compressor. More specifically, the present invention relates to what is called a low-pressure dome-type scroll compressor divided into a high-pressure space to which refrigerant is discharged from a compression mechanism and a low-pressure space in which a motor that drives the compression mechanism is disposed.

BACKGROUND ART

Conventionally, scroll compressors which are called as low-pressure dome-type scroll compressors have been known as in JP A No. 2013-167215. In the low-pressure dome-type scroll compressor, the inside of a casing is divided into a high-pressure space to which refrigerant is discharged from a scroll compression mechanism and a low-pressure space in which a motor that drives the scroll compression mechanism is disposed.

In the scroll compressor of JP A No. 2013-167215, the pressure of the refrigerant in a fluid passageway (a space to which the refrigerant is discharged from the scroll compression mechanism) formed in the back surface side (the side where the wrap is not formed) of the fixed scroll pushes the fixed scroll against the movable scroll to thereby reduce refrigerant leakage loss from the tips of the spirals of the scrolls and improve efficiency.

SUMMARY

However, in a case where the pressure in a single space (the fluid passageway) is utilized to push the fixed scroll and the movable scroll against each other as in the scroll compressor of JP-A No. 2013-167215, there are cases where it is difficult to adjust the pushing force. For that reason, in the scroll compressor of patent document 1 (JP-A No. 2013-167215), depending on operating conditions, there are cases where the pushing force becomes excessive and thrust loss increases and cases where the pushing force conversely becomes too small and refrigerant leakage loss increases.

For that reason, the scroll compressor disclosed in JP A No. 2013-167215 has room for improvement in terms of realizing high-efficiency operations in a wide range of operating conditions.

It is an objective of the present invention to provide a low-pressure dome-type scroll compressor in which it is easy to optimally adjust pushing force between a fixed scroll and a movable scroll and which can realize high-efficiency operations in a wide range of operating conditions.

A scroll compressor pertaining to a first aspect of the invention has a compression mechanism, a motor, a casing, a housing, a floating member, a first seal member, a first flow passage, and a second flow passage. The compression mechanism includes a fixed scroll and a movable scroll. The movable scroll is combined with the fixed scroll to form a compression chamber. The compression mechanism discharges refrigerant compressed in the compression chamber. The motor drives the movable scroll to cause the movable scroll to revolve with respect to the fixed scroll. The casing accommodates the compression mechanism and the motor. The inside of the casing is partitioned into a first space in which the motor is disposed and a second space into which the refrigerant discharged from the compression mechanism flows. The housing is accommodated inside the casing. The floating member is supported by the housing. The floating member is pushed toward the movable scroll by pressure in a back-pressure space formed between the floating member and the housing and pushes the movable scroll against the fixed scroll. The first seal member partitions the back-pressure space into a first chamber and a second chamber. The first flow passage guides the refrigerant in the middle of compression in the compression mechanism to the first chamber. The second flow passage guides the refrigerant discharged from the compression mechanism to the second chamber.

In the scroll compressor pertaining to the first aspect of the invention, the floating member pushes the movable scroll against the fixed scroll to reduce refrigerant leakage loss from the tips of the spirals of the scrolls. Additionally, in the scroll compressor pertaining to the first aspect of the invention, the back-pressure space that generates force that pushes the floating member toward the movable scroll is partitioned into the first chamber and the second chamber to which refrigerant in different stages of compression (normally refrigerant at different pressures) is guided. For that reason, it is easy to appropriately adjust the force with which the movable scroll is pushed against the fixed scroll, and high-efficiency operations of the scroll compressor can be realized in a wide range of operating conditions.

Furthermore, in the scroll compressor pertaining to the first aspect of the invention, the fixed scroll is not pushed against the movable scroll but rather the movable scroll is pushed against the fixed scroll. The structure of the back surface side (the side where the wrap is not formed) of the fixed scroll can therefore be simplified. For that reason, space for disposing relief mechanisms for preventing over-compression can be ensured without using a complex structure such as disclosed in JP A No. 2013-167215. Furthermore, since the fixed scroll does not move with respect to the movable scroll, it is easy to couple the injection pipe to the fixed scroll with good sealability.

A scroll compressor pertaining to a second aspect of the invention is the scroll compressor of the first aspect, wherein the dimensions of the first seal member change following the movement of the floating member.

In the scroll compressor pertaining to the second aspect of the invention, the back-pressure space can be partitioned into the first chamber and the second chamber even when the floating member moves, in the place where the first seal member is disposed, toward or away from the housing member that is combined with the floating member to form the back-pressure space. For that reason, there is high flexibility in the arrangement of the first seal member. Additionally, it is easy to simplify the structure for partitioning the first chamber and the second chamber from each other compared to the case of using a seal member whose dimensions do not change.

A scroll compressor pertaining to a third aspect of the invention is the scroll compressor of the second aspect, wherein an accommodation groove, which accommodates the first seal member, is formed in a surface of the floating member or the housing that is orthogonal to the moving direction of the floating member.

In the scroll compressor pertaining to the third aspect of the invention, the back-pressure space can be partitioned into the first chamber and the second chamber with a relatively simple structure and the force with which the movable scroll is pushed against the fixed scroll can be appropriately adjusted.

A scroll compressor pertaining to a fourth aspect of the invention is the scroll compressor of the third aspect, wherein the first seal member includes a U-seal and a plate spring. The plate spring urges the U-seal to the floating member in such a way as to widen the U-seal.

In the scroll compressor pertaining to the fourth aspect of the invention, the movable scroll can be pushed against the fixed scroll a certain extent even in a case where the pressure in the back-pressure space is low, such as just after operation starts. For that reason, defects in the startup of the compressor can be prevented from being caused by refrigerant leakage from the tips of the spirals of the scrolls.

A scroll compressor pertaining to a fifth aspect of the invention is the scroll compressor of any of the first aspect to the fourth aspect, wherein the first seal member seals the flow of the refrigerant from the second chamber to the first chamber but does not seal the flow of the refrigerant from the first chamber to the second chamber.

In the scroll compressor, normally, the pressure of the refrigerant discharged from the compression mechanism is higher than the pressure of the refrigerant in the middle of compression. In other words, normally, the pressure in the second chamber is higher than the pressure in the first chamber. However, in some operating conditions, there are cases where these pressures reverse so that the pressure in the first chamber becomes higher than the pressure in the second chamber.

In such cases, in the scroll compressor pertaining to the fifth aspect of the invention, the pressure in the compression chamber in the middle of compression can be released, via the first chamber and the second chamber, to the space (the second space) into which the refrigerant discharged from the compression mechanism flows. Therefore, instances such as excessive pressure acts on the compression mechanism due to liquid compression or other reasons and instances such as pushing force of the movable scroll against the fixed scroll becomes excessive due to an increase in the pressure in the back-pressure space can be prevented.

A scroll compressor pertaining to a sixth aspect of the invention is the scroll compressor of any of the first aspect to the fifth aspect and further has a second seal member and a third seal member. The second seal member is disposed between the floating member and the housing and seals between the first chamber and the first space. The third seal member is disposed between the floating member and the housing and seals between the second chamber and the first space.

In the scroll compressor pertaining to the sixth aspect of the invention, it is easy to reliably seal between the back-pressure space and the first space.

In the scroll compressor pertaining to the present invention, the floating member pushes the movable scroll against the fixed scroll to reduce refrigerant leakage loss from the tips of the spirals of the scrolls. Additionally, in the scroll compressor pertaining to this invention, the back-pressure space that generates force that pushes the floating member toward the movable scroll is partitioned into the first chamber and the second chamber to which refrigerant in different stages of compression (normally refrigerant at different pressures) is guided. For that reason, it is easy to appropriately adjust the force with which the movable scroll is pushed against the fixed scroll, and high-efficiency operations can be realized in a wide range of operating conditions.

DETAILED DESCRIPTION OF EMBODIMENT(S) EMBODIMENT

An embodiment of a scroll compressor pertaining to the invention will be described with reference to the drawings. It will be noted that the following embodiment is merely an example and can be appropriately changed in a range that does not depart from the spirit of the invention.

Figure 1:
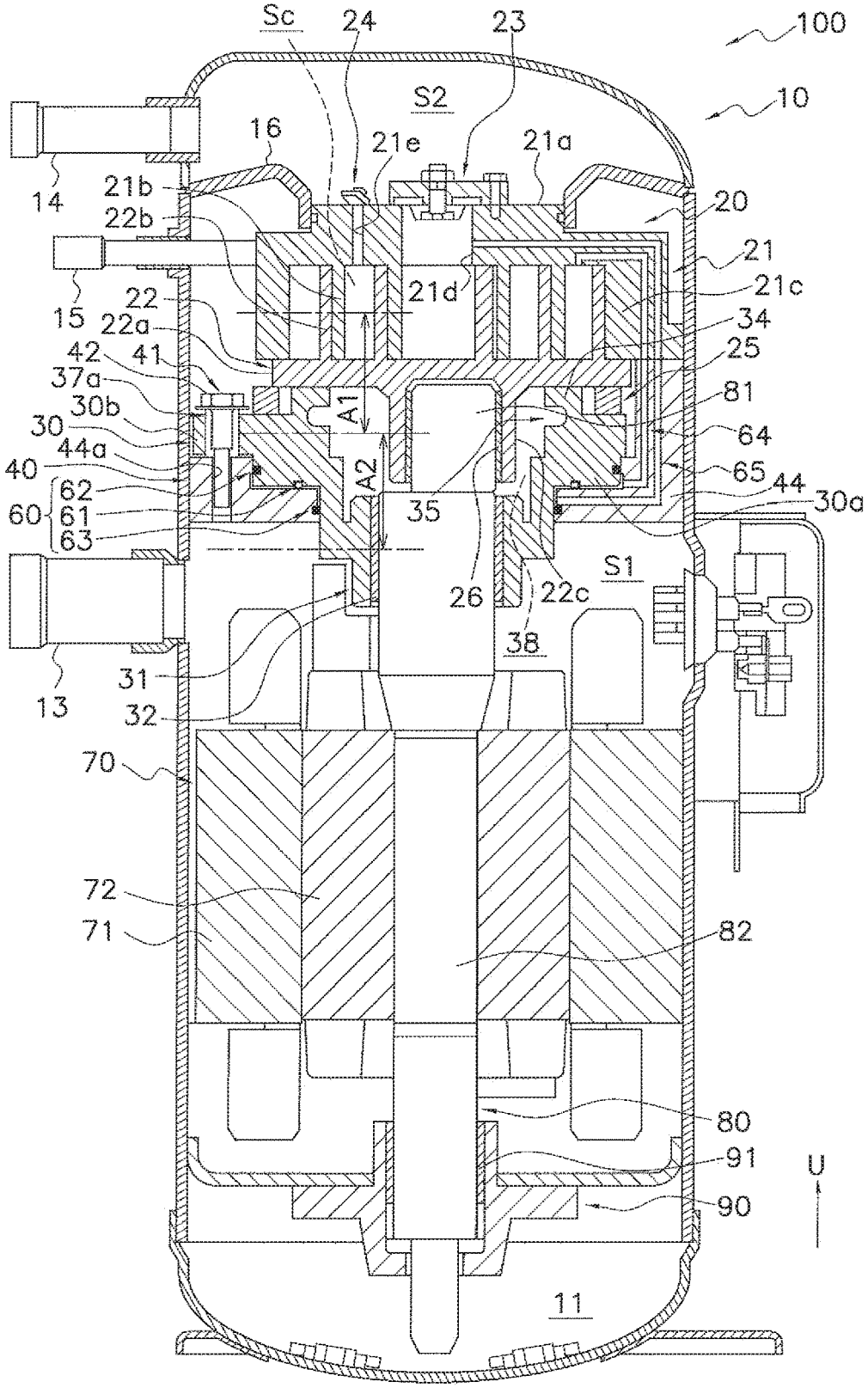
FIG. 1 is a general longitudinal sectional view of a scroll compressor pertaining to a first embodiment of the invention.

It will be noted that there are cases where expressions such as "upper" and "lower" are used to describe directions and/or dispositions, and unless otherwise specified, the direction of arrow U in FIG. 1 indicates "up".

Furthermore, in the following description, there are cases where expressions such as parallel, orthogonal, horizontal, vertical, and identical are used. These expressions do not always mean relationship being parallel, orthogonal, horizontal, vertical, or identical in a strict sense. Expressions such as parallel, orthogonal, horizontal, vertical, and identical include relationship being substantially parallel, orthogonal, horizontal, vertical, or identical.

(1) Overall Configuration

A scroll compressor 100 pertaining to a first embodiment of the invention will be described. The scroll compressor 100 is what is called a hermetic compressor. The scroll compressor 100 is a device that sucks in refrigerant and compresses and discharges the sucked-in refrigerant. The refrigerant is, for example, R32, which is one of HFC refrigerants. It will be noted that R32 is merely an example of the type of the refrigerant. The scroll compressor 100 may be a device that compresses and discharges a refrigerant other than R32.

The scroll compressor 100 is used in a refrigeration device. For example, the scroll compressor 100 is installed in an outdoor unit of an air conditioning system and configures a part of a refrigerant circuit of the air conditioning system.

As shown in FIG. 1, the scroll compressor 100 mainly has a casing 10, a compression mechanism 20, a floating member 30, a housing 40, a seal member 60, a motor 70, a drive shaft 80, and a lower bearing housing 90.

(2) Detailed Configuration

The housing 10, the compression mechanism 20, the floating member 30, the housing 40, the seal member 60, the motor 70, the drive shaft 80, and the lower bearing housing 90 of the scroll compressor 100 are described in detail below.

(2-1) Casing

The scroll compressor 100 has the casing 10 that is in the shape of a vertically long cylinder (see FIG. 1). The casing 10 accommodates various members constituting the scroll compressor 100, such as the compression mechanism 20, the floating member 30, the housing 40, the seal member 60, the motor 70, the drive shaft 80, and the lower bearing housing 90 (see FIG. 1).

The compression mechanism 20 is disposed in the upper portion of the casing 10. The floating member 30 and the housing 40 are disposed below the compression mechanism 20 (see FIG. 1). The motor 70 is disposed below the housing 40. The lower bearing housing 90 is disposed below the motor 70 (see FIG. 1). An oil accumulation space 11 is formed in the bottom portion of the casing 10 (see FIG. 1). Refrigerating machine oil for lubricating the compression mechanism 20 and the like is accumulated in the oil accumulation space 11.

The inside of the casing 10 is partitioned into a first space S1 and a second space S2. The inside of the casing 10 is partitioned into the first space S1 and the second space S2 by a partition plate 16 (see FIG. 1).

The partition plate 16 is a plate-like member formed in an annular shape as seen in a plan view. The inner peripheral side of the annular partition plate 16 is secured all the way around to the upper portion of a fixed scroll 21 of the compression mechanism 20 described later. Furthermore, the outer peripheral side of the partition plate 16 is secured all the way around to the inner surface of the casing 10. The partition plate 16 is secured to the fixed scroll 21 and the casing 10 so as to maintain airtightness between the space on the lower side of the partition plate 16 and the space on the upper side of the partition plate 16. The space on the lower side of the partition plate 16 is the first space S1, and the space on the upper side of the partition plate 16 is the second space S2.

The first space S is a space in which the motor 70 is disposed. The first space S1 is a space into which the refrigerant before compression by the scroll compressor 100 flows from the refrigerant circuit of the air conditioning system of which the scroll compressor 100 configures a part. In other words, the first space S is a space into which refrigerant at a low pressure in the refrigeration cycle flows. The second space S2 is a space into which the refrigerant discharged from the compression mechanism 20 (the refrigerant compressed by the compression mechanism 20) flows. In other words, the second space S2 is a space into which refrigerant at a high pressure in the refrigeration cycle flows. The scroll compressor 100 is what is called a low-pressure dome-type scroll compressor.

A suction pipe 13, a discharge pipe 14, and an injection pipe 15 are attached to the casing 10 so as to communicate the inside of the casing 10 to the outside (see FIG. 1).

The suction pipe 13 is attached to the middle portion of the casing 10 in the vertical direction (see FIG. 1). The suction pipe 13 is attached to the casing 10 at a height position between the housing 40 and the motor 70. The suction pipe 13 makes the outside of the casing 10 and the first space S1 inside the casing 10 communicate with each other. The refrigerant before compression (the refrigerant at a low pressure in the refrigeration cycle) flows through the suction pipe 13 into the first space S1 of the scroll compressor 100.

The discharge pipe 14 is attached to the upper portion of the casing 10 above the partition plate 16 (see FIG. 1). The discharge pipe 14 makes the outside of the casing 10 and the second space S2 inside the casing 10 communicate with each other. The refrigerant that has been compressed by the compression mechanism 20 and has flowed into the second space S2 (the refrigerant at a high pressure in the refrigeration cycle) flows out through the discharge pipe 14 to the outside of the scroll compressor 100.

The injection pipe 15 is attached to the upper portion of the casing 10 below the partition plate 16 so as to run through the casing 10 (see FIG. 1). The end portion of the injection pipe 15 that is on the inside of the casing 10 is, as in FIG. 1, connected to the fixed scroll 21 of the compression mechanism 20 described later. The injection pipe 15 communicates, via a passageway formed in the fixed scroll 21 (not shown in the drawings), with a compression chamber Sc in the middle of compression in the compression mechanism 20 described later. Refrigerant at a pressure (an intermediate pressure) between the low pressure and the high pressure in the refrigeration cycle is supplied via the injection pipe 15 from the refrigerant circuit of the air conditioning system of which the scroll compressor 100 configures a part to the compression chamber Sc in the middle of compression with which the injection pipe 15 communicates.

(2-2) Compression Mechanism

The compression mechanism 20 mainly has a fixed scroll 21 and a movable scroll 22 that is combined with the fixed scroll 21 to form the compression chamber Sc. The compression mechanism 20 compresses the refrigerant in the compression chamber Sc and discharges the compressed refrigerant. The compression mechanism 20 is, for example, a compression mechanism with an asymmetrical wrap structure but it may also be a compression mechanism with a symmetrical wrap structure.

(2-2-1) Fixed Scroll

The fixed scroll 21 is placed on top of the housing 40 (see FIG. 1). The fixed scroll 21 and the housing 40 are secured to each other by securing means (e.g., bolts) not shown in the drawings.

As shown in FIG. 1, the fixed scroll 21 has a fixed-side end plate 21*a* substantially in the shape of a disc, a fixed-side wrap 21*b* in the shape of a spiral that extends from the front surface (lower surface) of the fixed-side end plate 21*a* toward the movable scroll 22, and a peripheral edge portion 21*c* that surrounds the fixed-side wrap 21*b*.

The fixed-side wrap 21*b* is a wall-like member that projects downward (toward the movable scroll 22) from the lower surface of the fixed-side end plate 21*a*. When the fixed scroll 21 is viewed from below, the fixed-side wrap 21*b* is formed in a spiral shape (an involute shape) from near the center of the fixed-side end plate 21*a* toward the outer peripheral side.

The fixed-side wrap 21*b* and a movable-side wrap 22*b* of the movable scroll 22 described later are combined with each other to form the compression chamber Sc. The fixed scroll 21 and the movable scroll 22 are combined with each other in a state in which the front surface (lower surface) of the fixed-side end plate 21*a* and the front surface (upper surface) of a movable-side end plate 22*a* described later oppose each other, thereby forming the compression chamber Sc surrounded by the fixed-side end plate 21*a*, the fixed-side wrap 21*b*, the movable-side wrap 22*b*, and the movable-side end plate 22*a* of the movable scroll 22 described later (see FIG. 1). In a normal operating state, when the movable scroll 22 revolves with respect to the fixed scroll 21 as described later, the refrigerant that has flowed into the compression chamber Sc on the peripheral edge side from the first space S1 (the refrigerant at a low pressure in the refrigeration cycle) is compressed and increases in pressure as it moves to the compression chamber Sc on the center side.

In the substantial center of the fixed-side end plate 21*a*, a discharge port 21*d* through which the refrigerant compressed by the compression mechanism 21 is discharged is formed running through the fixed-side end plate 21*a* in the thickness direction thereof (in the vertical direction) (see FIG. 1). The discharge port 21*d* communicates with the compression chamber Sc on the center side (the innermost side) of the compression mechanism 20. A discharge valve 23 that opens and closes the discharge port 21*d* is attached to the top of the fixed-side end plate 21*d*. When the pressure in the compression chamber Sc on the innermost side with which the discharge port 21*d* communicates becomes a predetermined value greater than the pressure in the space (the second space S2) above the discharge valve 23, the discharge valve 23 opens and the refrigerant flows from the discharge port 21*d* into the second space S2.

Furthermore, relief holes 21*e*, running through the fixed-side end plate 21*a* in the thickness direction thereof, are formed in the fixed-side end plate 21*a* on the outer side than the discharge port 21*a* (see FIG. 1). The relief holes 21*e* communicate with compression chamber Sc formed on the outer side than the compression chamber Sc on the innermost side with which the discharge port 21*d* communicates. The relief holes 21*e* communicate with the compression chamber Sc in the middle of compression in the compression mechanism 20. Although it is not limited thereto, a plurality of the relief holes 21*e* are formed in the fixed-side end plate 21*a*. Relief valves 24 that open and close the relief holes 21*e* are attached to the top of the fixed-side end plate 21*a*. When the pressure in the compression chamber Sc with which the relief holes 21*e* communicate becomes a predetermined value greater than the pressure in the space (the second space S2) above the relief valves 24, the relief valves 24 open and the refrigerant flows from the relief holes 21*e* into the second space S2.

The peripheral edge portion 21*c* is formed in the shape of a thick-walled open cylinder. The peripheral edge portion 21*c* is disposed on the outer peripheral side of the fixed-side end plate 21*a* so as to surround the fixed-side wrap 21*b* (see FIG. 1).

(2-2-2) Movable Scroll

As shown in FIG. 1, the movable scroll 22 mainly has a movable-side end plate 22*a* substantially in the shape of a disc, a movable-side wrap 22*b* in the shape of a spiral that extends from the front surface (upper surface) of the movable-side end plate 22*a* toward the fixed scroll 21, and a boss portion 22*c* formed in the shape of an open cylinder that projects from the back surface (lower surface) of the movable-side end plate 22*a*.

The movable-side wrap 22*b* is a wall-like member that projects upward (toward the fixed scroll 21) from the upper surface of the movable-side end plate 22*a*. When the movable scroll 22 is viewed from above, the movable-side wrap 22*b* is formed in a spiral shape (an involute shape) from near the center of the movable-side end plate 22*a* toward the outer peripheral side.

The movable-side end plate 22*a* is disposed above the floating member 30.

During the operation of the scroll compressor 100, the floating member 30 is pushed toward the movable scroll 22 by pressure in a back-pressure space B (see FIG. 4) formed below the floating member 30. Thereby, a pushing portion 34 disposed on the upper portion of the floating member 30 described later abuts against the back surface (lower surface) of the movable-side end plate 22*a*, and the floating member 30 pushes the movable scroll 22 against the fixed scroll 21. By the force with which the floating member 30 pushes the movable scroll 22 against the fixed scroll 21, the movable scroll 22 tightly contacts the fixed scroll 21 so that leakage of the refrigerant from a gap between the tip of the fixed-side wrap 21*b* and the movable-side end plate 22*a* and a gap between the tip of the movable-side wrap 22*b* and the fixed-side end plate 21*a* is reduced.

It will be noted that the back-pressure space B is a space formed between the floating member 30 and the housing 40. The back-pressure space B is a space formed mainly on the back surface side (lower side) of the floating member 30 (see FIG. 4). The refrigerant in the compression chamber Sc of the compression mechanism 20 is guided to the back-pressure space B. The back-pressure space B is a space scaled from the first space S1 around the back-pressure space B (see FIG. 4). Normally, during the operation of the scroll compressor 100, the pressure in the back-pressure space B is higher than the pressure in the first space S1.

An Oldham coupling 25 is disposed between the movable scroll 22 and the floating member 30 (see FIG. 1). The Oldham coupling 25 functions as a mechanism for preventing self-rotation of the movable scroll 22. The Oldham coupling 25 slidably engages with both the movable scroll 22 and the floating member 30, regulates self-rotation of the movable scroll 22, and allows the movable scroll 22 to orbit with respect to the fixed scroll 21.

The boss portion 22*c* is a portion in the shape of an open cylinder whose upper end is closed off by the movable-side end plate 22*a*. The boss portion 22*c* is disposed in an eccentric portion space 38 which is surrounded by the inner surface of the floating member 30 (see FIG. 1). A bearing metal 26 is disposed in the hollow portion of the boss portion 22*c* (see FIG. 1). Although the method of attachment is not limited, the bearing metal 26 is press-fitted into and secured to the hollow portion of the boss portion 22*c*. An eccentric portion 81 of the drive shaft 80 is inserted into the bearing metal 26. The movable scroll 22 and the drive shaft 80 are coupled to each other as a result of the eccentric portion 81 being inserted into the bearing metal 26.

(2-3) Floating Member

The floating member 30 is disposed on the back surface side of the movable scroll 22 (the opposite side of the side where the fixed scroll 21 is disposed) (see FIG. 1). The floating member 30 is a member that is pushed toward the movable scroll 22 by the pressure in the back-pressure space B and pushes the movable scroll 22 against the fixed scroll 21. Furthermore, a part of the floating member 30 also functions as a bearing that pivotally supports the drive shaft 80.

Figure 2:
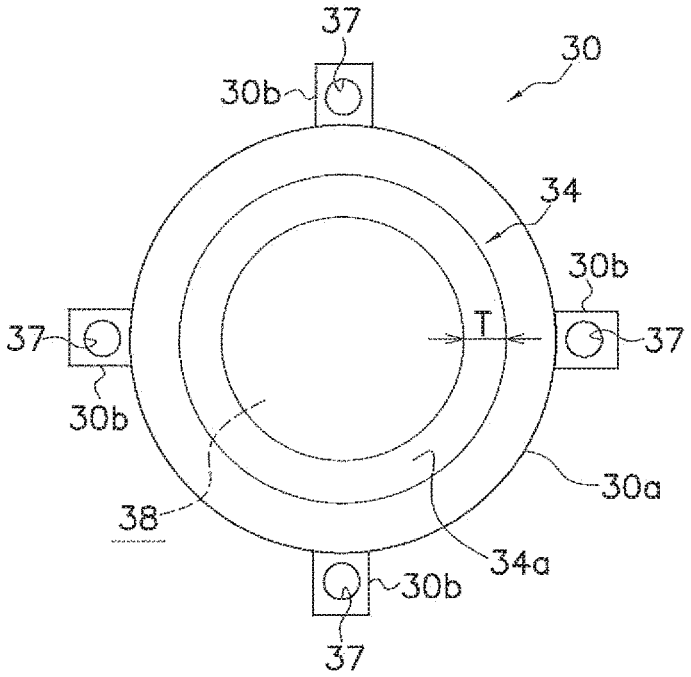
FIG. 2 is a general plan view of a floating member of the scroll compressor of FIG. 1.
Figure 5:
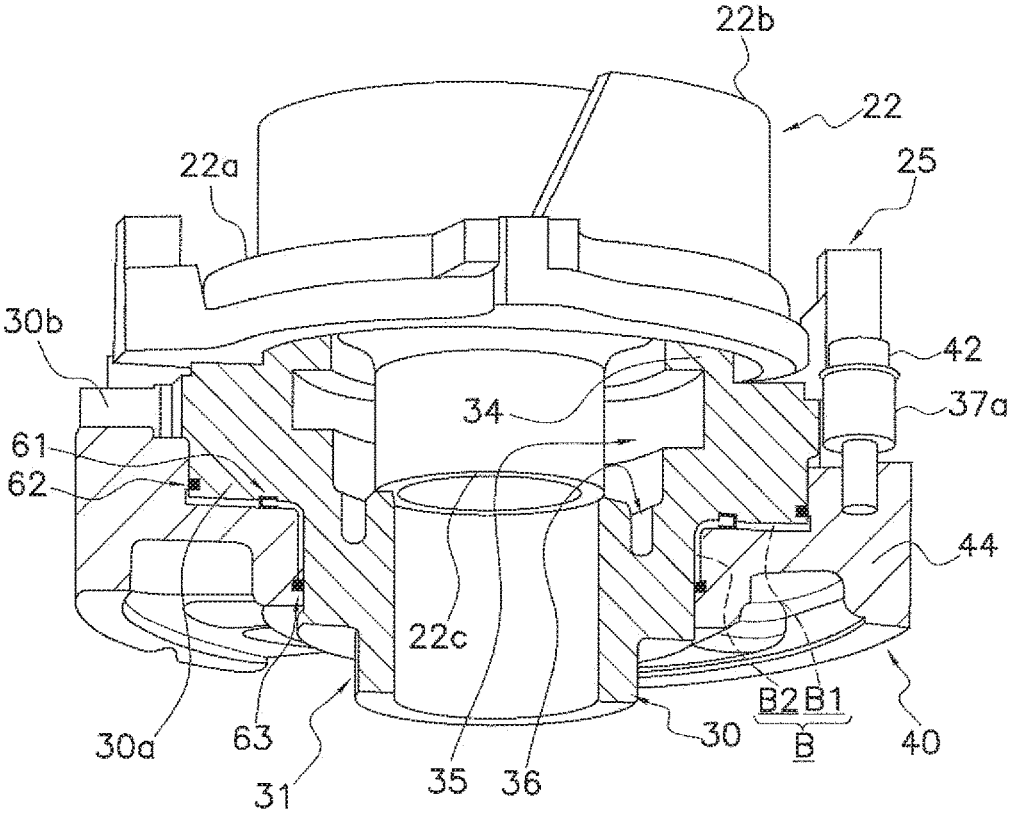
FIG. 5 is a perspective view of the region around a movable scroll, the floating member, and a housing of the scroll compressor of FIG. 1. The floating member and the housing are shown in cross section.

The floating member 30 mainly has a cylinder portion 30*a*, a pushing portion 34, projecting portions 30*b*, and an upper bearing housing 31 (see FIG. 1, FIG. 2, and FIG. 5).

The cylinder portion 30*a* is formed generally in the shape of an open cylinder. The eccentric portion space 38 surrounded by the inner surface of the cylinder portion 30*a* is formed in the hollow portion of the cylinder portion 30*a* (see FIG. 1). The boss portion 22*c* of the movable scroll 22 is disposed in the eccentric portion space 38 (see FIG. 1).

The pushing portion 34 is a member formed generally in the shape of an open cylinder. The pushing portion 34 extends from the cylinder portion 30*a* toward the movable scroll 22. A thrust surface 34*a* (see FIG. 4) on the upper end portion of the pushing portion 34 opposes the back surface of the movable-side end plate 22*a* of the movable scroll 22. The thrust surface 34*a* is formed in the shape of a ring as seen in a plan view as in FIG. 2. When the floating member 30 is pushed toward the movable scroll 22 by the pressure in the back-pressure space B, the thrust surface 34*a* abuts against the back surface of the movable-side end plate 22*a* and pushes the movable scroll 22 against the fixed scroll 21.

It will be noted that, during the operation of the scroll compressor 100, there are cases where the movable-side end plate 22*a* tilts with respect to a horizontal plane due to force that acts on the movable scroll 22. In such cases, it is preferred that the thrust surface 34*a* tilts following the tilting of the movable-side end plate 22*a* in order to reduce partial contact between the thrust surface 34*a* and the movable-side end plate 22*a*. For that reason, in this embodiment, an elastic groove 35 is formed all around the inner surface of the pushing portion 34 (see FIG. 4). The elastic groove 35 is formed in the base portion of the pushing portion 34 (near the portion that connects to the cylinder portion 30*a*).

Figure 3:
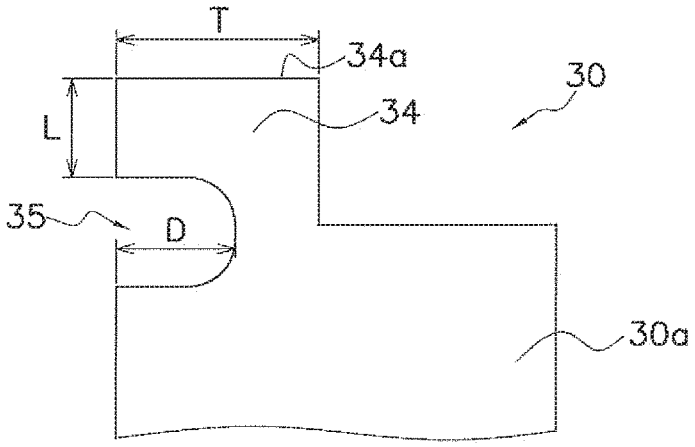
FIG. 3 is a drawing for describing the design of preferred dimensions around a thrust portion of the floating member of the scroll compressor of FIG. 1.

It will be noted that, when providing the elastic groove 35, it is preferred that there be a relationship of equation (1) below between a thickness T of the thrust surface 34*a* in the radial direction (see FIG. 3), a distance L from the thrust surface 34*a* to the elastic groove 35 in the axial direction of the drive shaft 80 (here, the vertical direction) (see FIG. 3), and a depth D of the elastic groove 35 in the radial direction (see FIG. 3). When the relationship of equation (1) is established, it becomes particularly easier to allow the thrust surface 34*a* to follow the tilting of the movable-side end plate 22*a*.

$$(D/T)^2/(L/T)^3 \leq 0.6 \quad (1)$$

The projecting portions 30*b* are tabular members that extend outward in the radial direction from the outer peripheral edge of the cylinder portion 30*a* (see FIG. 2). The floating member 30 has a plurality of the projecting portions 30*b*. In each projecting portion 30*b*, a hole 37 that runs through it in the axial direction of the drive shaft 80 (the vertical direction) is formed (see FIG. 2). In each hole 37, a bush 37*a* serving as an example of a supported portion is disposed (see FIG. 1). The bushes 37*a* are plurally disposed along the circumferential direction when the floating member 30 is viewed in the axial direction of the drive shaft 80 (here, in a plan view). The bushes 37*a* of the floating member 30 are supported, so as to be slidable in the axial direction of the drive shaft 80, by support portions 41 of the housing 40.

The support portions 41 include bolts 42 (see FIG. 1 and FIG. 5). The bolts 42 are inserted through the bushes 37*a*. The bolts 42 are screwed into screw holes 44*a* formed in a housing body 44 of the housing 40 described later and are secured to the housing body 44. When force acts on the floating member 30 in a direction toward the movable scroll 22 or in a direction away from the movable scroll 22, each of the bushes 37*a* slides with respect to the bolt 42 which is inserted through that bushes 37*a*, and the floating member 30 thereby moves in the axial direction of the drive shaft 80. It will be noted that the direction of the force that acts on the floating member 30 depends on a balance between, for example, the force with which the floating member 30 is pushed by the pressure in the back-pressure space B, the force with which the pressure in the compression chamber Sc pushes the movable scroll 22 toward the floating member 30, and the force of gravity that acts on the movable scroll 22 and the floating member 30.

In the present embodiment, the floating member 30 has four projecting portions 30*b* disposed at equal angle-intervals around the center of the floating member 30. However, the number of the projecting portions 30*b* in the present embodiment is an example and is not limited to four. The number of the projecting portions 30*b* may be appropriately decided. However, from the standpoint of reducing tilting of the floating member 30, it is preferred that the floating member 30 have three or more of the projecting portions 30*b*.

The upper bearing housing 31 is disposed below the cylinder portion 30*a* (below the eccentric portion space 38). The upper bearing housing 31 is formed generally in the shape of an open cylinder (see FIG. 1). A bearing metal 32 is disposed inside the upper bearing housing 31. The bearing metal 32 is an example of a bearing. Although the method of attachment is not limited, the bearing metal 32 is press-fitted into and secured to the hollow portion of the upper bearing housing 31. A main shaft 82 of the drive shaft 80 is inserted through the bearing metal 32. The bearing metal 32 of the upper bearing housing 31 pivotally supports the main shaft 82 of the drive shaft 80.

It will be noted that it is preferred that the upper bearing housing 31 tilts following the tilting of the main shaft 82 in order to reduce partial contact between the bearing metal 32 and the main shaft 82 when the main shaft 82 of the drive shaft 80 tilts due to the effects of, for example, the force that acts on the movable scroll 22. For that reason, in this embodiment, an annular elastic groove 36 is formed in the portion where the cylinder portion 30*a* and the upper bearing housing 31 connect to each other so as to surround the upper bearing housing 31 (see FIG. 4).

It will be noted that the floating member 30 is not only configured to push the movable scroll 22 toward the fixed scroll 21 but also the floating member 30 has the upper bearing housing 31 and functions as a bearing for the drive shaft 80. This configuration has the following effect.

When the floating member 30 receives force from the movable scroll 22, the force produces moments that act on the floating member 30 around the bushes 37*a* supporting the floating member 30. However, because the floating member 30 has the upper bearing housing 31, the moments around the bushes 37*a* produced by the force acting from the movable scroll 22 are easily offset by the moments around the bushes 37*a* resulting from the force that the upper bearing housing 31 receives.

It will be noted that in order to make it easier for this effect to be obtained, it is preferred that the ratio (A2/A1) of a distance A1 from a center of each bush 37*a* to a center of the movable-side wrap 22*b* in the axial direction of the drive shaft 80 to a distance A2 from a center of the bearing metal 32 to the center of each bush 37*a* in the axial direction of the drive shaft 80 falls within a range from 0.5 to 1.5 (see FIG. 1). More preferably, it is preferred that the ratio (A2/A1) of the distance A1 from the center of each bush 37*a* to the center of the movable-side wrap 22*b* in the axial direction of the drive shaft 80 to the distance A2 from the center of the bearing metal 32 to the center of each bushes 37*a* in the axial direction of the drive shaft 80 falls within a range from 0.7 to 1.3.

However, the configuration of the floating member 30 is an example, and the floating member 30 may have just the function of pushing the movable scroll 22 toward the fixed scroll 21. In that case, for example, instead of the floating member 30, the housing 40 may have a function as a bearing for the drive shaft 80.

(2-4) Housing

The housing 40 is disposed below the fixed scroll 21 (see FIG. 1). The fixed scroll 21 is secured to the housing 40 by, for example, bolts not shown in the drawings. Furthermore, the housing 40 is disposed below the floating member 30 (see FIG. 1). The housing 40 supports the floating member 30. The back-pressure space B is formed between the housing 40 and the floating member 30 (see FIG. 4 and FIG. 5).

The housing 40 has a housing body 44 and support portions 41 (see FIG. 1).

The housing body 44 is a member formed generally in the shape of an open cylinder. The housing body 44 is attached to the inner surface of the casing 10. Although the method of securement is not limited, the housing body 44 is attached to the inner surface of the casing 10 by press-fitting.

The support portions 41 support, slidably in the axial direction of the drive shaft 80 (the vertical direction), the bushes 37*a* disposed in the floating member 30 (disposed in the holes 37 of the projecting portions 30*b*). The support portions 41 include the bolts 42 (see FIG. 1 and FIG. 5). The bolts 42 are inserted through the bushes 37*a*. The bolts 42 are screwed into the screw holes 44*a* formed in the housing body 44 and are secured to the housing body 44. When force acts on the floating member 30 in a direction toward the movable scroll 22 or in a direction away from the movable scroll 22, the bushes 37*a* of the floating member 30 slide with respect to the bolts 42 and, the floating member 30 thereby moves in the axial direction of the drive shaft 80.

(2-5) Seal Member

The seal member 60 (see FIG. 1) is a member for forming the back-pressure space B between the floating member 30 and the housing 40. Furthermore, the seal member 60 is a member that partition the back-pressure space B into a first chamber B1 and a second chamber B2 (see FIG. 4). In the present embodiment, the first chamber B1 and the second chamber B2 are spaces formed generally in annular shapes as seen in a plan view. The second chamber B2 is disposed on the inner side of the first chamber B1. As seen in a plan view, the area of the first chamber B1 is greater than the area of the second chamber B2.

The first chamber B1 communicates via a first flow passage 64 with a compression chamber Sc in the middle of compression. The first flow passage 64 is a refrigerant flow passage that guides to the first chamber B1 the refrigerant in the middle of compression in the compression mechanism 20. The first flow passage 64 is formed in the fixed scroll 21 and the housing 40. The second chamber B2 communicates via a second flow passage 65 with the discharge port 21*d* of the fixed scroll 21. The second flow passage 65 is a refrigerant flow passage that guides to the second chamber B2 the refrigerant discharged from the compression mechanism 20. The second flow passage 65 is formed in the fixed scroll 21 and the housing 40.

Because the scroll compressor 100 is configured as described above, during the operation of the scroll compressor 100, normally, the pressure in the second chamber B2 is higher than the pressure in the first chamber B1. In this embodiment, as seen in a plan view, the area of the first chamber B1 is greater than the area of the second chamber B2. It is therefore difficult for the force, generated at the back-pressure space B, with which the movable scroll 22 is pushed against the fixed scroll 21 to become excessive. Furthermore, as the pressure in the compression chamber Sc normally becomes greater inward, an arrangement disposing the second chamber B2 whose pressure is normally higher on the inner side than the first chamber B1 makes it easy to balance between the force with which the movable scroll 22 is pushed downward by the pressure in the compression chamber Sc and the force with which the floating member 30 pushes the movable scroll 22 upward.

The seal member 60 include a first seal member 61, a second seal member 62, and a third seal member 63 (see FIG. 1).

In this embodiment, the second seal member 62 and the third seal member 63 are O-rings, but they are not limited thereto. O-rings are annular gaskets with a circular cross section. The second seal member 62 and the third seal member 63 are, for example, made of synthetic resin. It will be noted that the material of the second seal member 62 and the third seal member 63 may be appropriately decided depending, for example, on the use temperature, and the types of the refrigerating machine oil and the refrigerant with which the second seal member 62 and the third seal member 63 contact.

Figure 4:
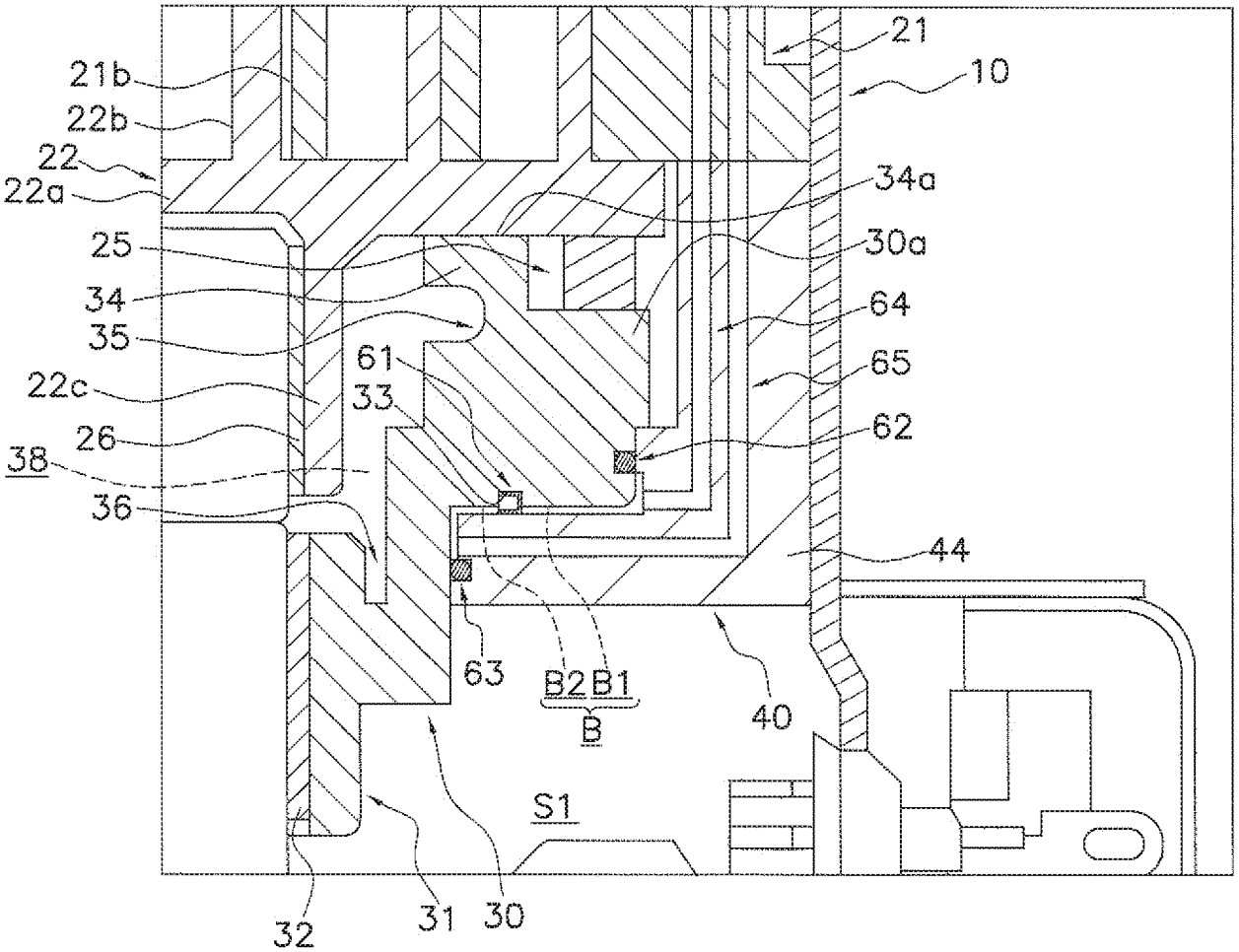
FIG. 4 is an enlarged view of the region around the floating member of the scroll compressor of FIG. 1.

The second seal member 62 is disposed in an annular groove formed in the outer side surface of the cylinder portion 30*a* of the floating member 30 (see FIG. 4). The outer side surface of the cylinder portion 30*a* where the annular groove is disposed opposes the inner side surface of the housing body 44 of the housing 40. The third seal member 63 is disposed in an annular groove formed in the inner side surface of the housing body 44 (see FIG. 4). The inner side surface of the housing body 44 where the annular groove is disposed opposes the portion of the floating member 30 where the cylinder portion 30*a* and the upper bearing housing 31 connect to each other. In this embodiment, the second seal member 62 is disposed in an annular groove formed in the floating member 30. However, the second seal member 62 may be disposed in an annular groove formed in the housing 40 instead. Further, although the third seal member 63 is disposed in an annular groove formed in the housing 40 in this embodiment, the third seal member 63 may be disposed in an annular groove formed in the floating member 30 instead.

The back-pressure space B is formed between the floating member 30 and the housing 40 by the second seal member 62 and the third seal member 63 (see FIG. 4). That is, the second seal member 62 and the third seal member 63 seal between the back-pressure space B and the first chamber S1 so as to maintain airtightness. In particular, the second seal member 62 seals between the first chamber B1 of the back-pressure space B and the first space S1. In particular, the third seal member 63 seals between the second chamber B2 of the back-pressure space B and the first space S1.

The first seal member 61 is a member that partitions the back-pressure space B into the first chamber B1 and the second chamber B2. The first chamber B1 and the second chamber B2 are adjacent to each other across the first seal member 61 (see FIG. 4).

The first seal member 61 is accommodated in an accommodation groove 33 formed in the surface of the floating member 30 that is orthogonal to the moving direction of the floating member 30 (the axial direction of the drive shaft 80, the vertical direction in this embodiment) (see FIG. 4). The accommodation groove 33 is formed in the bottom surface of the cylinder portion 30*a* of the floating member 30. The bottom surface of the cylinder portion 30*a* of the floating member 30 is the surface that opposes the upper surface of the housing body 44 of the housing 40. Although, in this embodiment, the accommodation groove 33 is formed in the floating member 30, an accommodation groove in which the first seal member 61 is accommodated may be formed in the surface of the housing body 44 of the housing 40 that is orthogonal to the moving direction of the floating member 30 instead.

Figure 6:
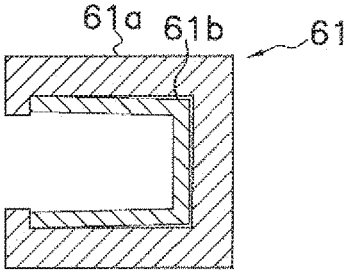
FIG. 6 is a general sectional view of a first seal member for describing the structure of the first seal member of the scroll compressor of FIG. 1.

The first seal member 61 is an annular gasket with a U-shaped cross section (see FIG. 6).

The structure of the first seal member 61 will be described. The first seal member 61 includes an annular U-seal 61*a*, which has a U-shaped cross section, and a plate spring 61*b* (see FIG. 6). The U-seal 61*a* is made of synthetic resin, for example. The plate spring 61*b* is made of metal, for example. The plate spring 61*b* is formed so as to have a U-shaped cross section like the U-seal 61*a*. The plate spring 61*b* may be an annular member like the U-seal 61*a* or may be a noncontinuous (non-annular) member disposed in plural places inside the U-seal 61*a*. The plate spring 61*b* is disposed inside the U-seal 61*a* in a posture in which the plate spring 61*b* opens in the same direction as the U-seal 61*a* (see FIG. 6). The plate spring 61*b* urges the U-seal 61*a* to the floating member 30 in such a way as to widen the U-seal 61*a*.

The first seal member 61 is a gasket that is deformable in such a way that the opening portion of the "U" becomes wider or in such a way that the opening portion of the "U" becomes narrower. Because the first seal member 61 is accommodated in the accommodation groove 33 as described above in a state in which its opening faces sideways, its dimension changes following the movement of the floating member 30.

In a state in which the scroll compressor 100 is not operating and the entire inside of the casing 10 is generally at an identical pressure, the first seal member 61 is in a state in which it is pushed from upward by the weight of the movable scroll 22 and the floating member 30. In this state, the open portion of the "U" of the first seal member 61 is in a narrowed state compared to a state when force is not acting on the first seal member 61. However, even in this state, the first seal member 61 is not in a state in which it is crushed by the weight of the movable scroll 22 and the floating member 30 but is in a state in which the plate spring 61*b* is urging the U-seal 61*a* to the floating member 30.

The first seal member 61 that has the U-shaped cross section is accommodated in the accommodation groove 33 of the floating member 30 in a state in which its opening faces sideways. In particular, the first seal member 61 is accommodated in the accommodation groove 33 of the floating member 30 in a state in which its opening faces the inner peripheral side. That is, the first seal member 61 is accommodated in the accommodation groove 33 of the floating member 30 in a state in which its opening faces the second chamber B2. Since the first seal member 61 is configured in the accommodation groove 33 in this posture, the first seal member 61 functions as follows.

As described above, normally, the pressure in the second chamber B2 on the inner side is higher than the pressure in the first chamber B1 on the outer side. When the pressure in the second chamber B2 is higher than the pressure in the first chamber B1, the first seal member 61 becomes deformed in such a way that its opening opens. Therefore, the flow of the refrigerant from the second chamber B2 to the first chamber B1 is sealed. Thereby, it is prevented that the pressures of both of the first chamber B1 and the second chamber B2 become relatively high (having the same pressure as the refrigerant discharged from the compression mechanism 20). As a result, it is difficult for the force, generated at the back-pressure space B, with which the movable scroll 22 is pushed against the fixed scroll 21 to become excessive.

As described above, normally, the pressure in the second chamber B2 on the inner side is higher than the pressure in the first chamber B1 on the outer side. However, depending on operating conditions (e.g., in a case where the pressure of the low pressure in the refrigeration cycle is relatively high), there are cases where the pressure in the compression chamber Sc in the middle of compression (the pressure in the compression chamber Sc on the outer side than the compression chamber Sc on the innermost side) becomes higher than the pressure in the compression chamber Sc on the innermost side. In this case, the pressure in the first chamber B1 on the outer side becomes higher than the pressure in the second chamber B2 on the inner side. In a case where the pressure in the first chamber B1 is higher than the pressure in the second chamber B2, the first seal member 61, due to its structure, does not seal the flow of the refrigerant from the first chamber B1 to the second chamber B2. As a result, the pressure in the compression chamber Sc in the middle of compression can be released, via the first chamber B1 and the second chamber B2, to the space (the second space S2) into which the refrigerant discharged from the compression mechanism flows. For that reason, instances such as excessive pressure acts on the compression mechanism 20 due to liquid compression or other reasons and instances such as pushing force of the movable scroll 22 against the fixed scroll 21 becomes excessive due to an increase in the pressure in the back-pressure space B can be prevented.

(2-6) Motor

The motor 70 drives the movable scroll 22. The motor 70 has an annular stator 71, which is secured to the inner wall surface of the casing 10, and a rotor 72, which is rotatably accommodated on the inner side of the stator 71 with a slight gap (air gap) between them (see FIG. 1).

The rotor 72 is a member in the shape of an open cylinder, and the drive shaft 80 is inserted through the inside of the rotor 72. The rotor 72 is coupled to the movable scroll 22 via the drive shaft 80. The rotor 72 rotates, whereby the motor 70 drives the movable scroll 22 so that the movable scroll 22 revolves with respect to the fixed scroll 21.

(2-7) Drive Shaft

The drive shaft 80 couples the rotor 72 of the motor 70 and the movable scroll 22 of the compression mechanism 20 to each other. The drive shaft 80 extends in the vertical direction. The drive shaft 80 transmits the driving force of the motor 70 to the movable scroll 22.

The drive shaft 80 mainly has the eccentric portion 81 and the main shaft 82 (see FIG. 1).

The eccentric portion 81 is disposed on the upper end of the main shaft 82. The central axis of the eccentric portion 81 is eccentric with respect to the central axis of the main shaft 82. The eccentric portion 81 is coupled to the bearing metal 26 disposed inside the boss portion 22*c* of the movable scroll 22.

The main shaft 82 is pivotally supported by the bearing metal 32 disposed in the upper bearing housing 31 provided in the floating member 30 and a bearing metal 91 disposed in the lower bearing housing 90 described later. Furthermore, the main shaft 82 is inserted through and coupled to the rotor 72 of the motor 70 between the upper bearing housing 31 and the lower bearing housing 90. The main shaft 82 extends in the vertical direction.

An oil passageway not shown in the drawings is formed in the drive shaft 80. The oil passageway has a main path (not shown in the drawings) and branch paths (not shown in the drawings). The main path extends in the axial direction of the drive shaft 80 from the lower end of the drive shaft 80 to the upper end of the drive shaft 80. The branch paths extend in the radial direction of the drive shaft 80 from the main path. The refrigerating machine oil in the oil accumulation space 11 is sucked up by a pump (not shown in the drawings) provided in the lower end of the drive shaft 80 and is supplied through the oil passageway to sliding portions between the drive shaft 80 and the bearing metals 26, 32, and 91 and sliding portions of the compression mechanism 20 and the like.

(2-8) Lower Bearing Housing

The lower bearing housing 90 (see FIG. 1) is secured to the inner surface of the casing 10. The lower bearing housing 90 (see FIG. 1) is disposed below the motor 70. The lower bearing housing 90 has a hollow portion substantially in the shape of a cylinder. The bearing metal 91 is disposed in the hollow portion. Although the method of attachment is not limited, the bearing metal 91 is secured by press-fitting into the hollow portion of the lower bearing housing 90. The main shaft 82 of the drive shaft 80 is inserted through the bearing metal 91. The bearing metal 91 pivotally supports the lower portion side of the main shaft 82 of the drive shaft 80.

(3) Operation of Scroll Compressor

The operation of the scroll compressor 100 will be described. It will be noted that here the operation of the scroll compressor 100 in a normal state, that is a state in which the pressure of the refrigerant discharged from the discharge port 21*d* of the compression mechanism 20 is higher than the pressure in the compression chamber Sc in the middle of compression, will be described.

When the motor 70 is driven, the rotor 72 rotates and the drive shaft 80 coupled to the rotor 72 also rotates. When the drive shaft 80 rotates, the movable scroll 22 orbits with respect to the fixed scroll 21 without self-rotating because of the working of the Oldham coupling 25. The refrigerant at a low pressure in the refrigeration cycle that has flowed into the first space S1 from the suction pipe 13 travels through a refrigerant passageway (not shown in the drawings) formed in the housing 40 and is sucked into the compression chamber Sc on the peripheral edge side of the compression mechanism 20. As the movable scroll 22 orbits, the first space S1 and the compression chamber Sc no longer communicate with each other. As the movable scroll 22 orbits further, the volume of the compression chamber Sc decreases and the pressure in the compression chamber Sc increases. Furthermore, refrigerant is injected from the injection pipe 15 into the compression chamber Sc in the middle of compression. The refrigerant increases in pressure as it moves from the compression chamber Sc on the peripheral edge side (outer side) to the compression chamber Sc on the central side (inner side) and eventually reaches a high pressure in the refrigeration cycle. The refrigerant compressed by the compression mechanism 20 is discharged to the second space S2 through the discharge port 21*d* positioned near the center of the fixed-side end plate 21*a*. The refrigerant at a high pressure in the refrigeration cycle in the second space S2 is discharged from the discharge pipe 14.

(4) Characteristics (4-1)

The scroll compressor 100 of the present embodiment has the compression mechanism 20, the motor 70, the casing 10, the floating member 30, the housing 40, the first seal member 61, the first flow passage 64, and the second flow passage 65. The compression mechanism 20 includes the fixed scroll 21 and the movable scroll 22. The movable scroll 22 is combined with the fixed scroll 21 to form the compression chamber Sc. The compression mechanism 20 discharges the refrigerant compressed in the compression chamber Sc. The motor 70 drives the movable scroll 22 to cause the movable scroll 22 to revolve with respect to the fixed scroll 21. The casing 10 accommodates the compression mechanism 20 and the motor 70. The inside of the casing 10 is partitioned into the first space S1 in which the motor 70 is disposed and the second space S2 into which the refrigerant discharged from the compression mechanism 20 flows. The floating member 30 is pushed toward the movable scroll 22 by the pressure in the back-pressure space B and pushes the movable scroll 22 against the fixed scroll 21. The housing 40 supports the floating member 30. The back-pressure space B is formed between the housing 40 and the floating member 30. The first seal member 61 partitions the back-pressure space B into the first chamber B and the second chamber B2. The first flow passage 64 guides to the first chamber B1 the refrigerant in the middle of compression in the compression mechanism 20. The second flow passage 65 guides to the second chamber B2 the refrigerant discharged from the compression mechanism 20.

In the scroll compressor 100 of the present embodiment, the floating member 30 pushes the movable scroll 22 against the fixed scroll 21 to reduce refrigerant leakage loss from the tips of wraps of the scrolls is reduced. Additionally, in the scroll compressor 100 of the present embodiment, the back-pressure space B that generates force that pushes the floating member 30 toward the movable scroll 22 is partitioned into the first chamber B1 and the second chamber B2 to which refrigerant in different stages of compression (normally refrigerant at different pressures) is guided. For that reason, it is easy to appropriately adjust the force with which the movable scroll 22 is pushed against the fixed scroll 21, and high-efficiency operations of the scroll compressor 100 can be realized in a wide range of operating conditions.

Furthermore, in the scroll compressor 100 of the present embodiment, the fixed scroll 21 is not pushed against the movable scroll 22 but rather the movable scroll 22 is pushed against the fixed scroll 21. The structure of the back surface side (the side where the fixed-side wrap 21*b* is not formed) of the fixed scroll 21 can therefore be simplified. For that reason, space for disposing relief mechanisms (the relief valves 24) for preventing over-compression can be ensured without using a complex structure such as disclosed in patent document 1 (JP-A No. 2013-167215). Furthermore, since the fixed scroll 21 does not move with respect to the movable scroll 22, it is easy to couple the injection pipe 15 to the fixed scroll 21 with good sealability.

(4-2)

In the scroll compressor 100 of the present embodiment, the dimensions of the first seal member 61 change following the movement of the floating member 30.

In the scroll compressor 100 of the present embodiment, the back-pressure space B can be partitioned into the first chamber B1 and the second chamber B1 even when the floating member 30 moves, in the place where the first seal member 61 is disposed, toward or away from the housing member 40 that is combined with the floating member 30 to form the back-pressure space B. For that reason, there is high flexibility in the arrangement of the first seal member 61. Additionally, it is easy to simplify the structure for partitioning the first chamber B1 and the second chamber B2 from each other compared to the case of using a seal member whose dimensions do not change.

(4-3)

In the scroll compressor 100 of the present embodiment, the accommodation groove 33, which accommodates the first seal member 61, is formed in the surface of the floating member 30 that is orthogonal to the moving direction of the floating member 30 (the axial direction of the drive shaft 80; in the present embodiment, the vertical direction).

In the scroll compressor 100 of the present embodiment, the back-pressure space B can be partitioned into the first chamber B1 and the second chamber B2 with a relatively simple structure and the force with which the movable scroll 22 is pushed against the fixed scroll 21 can be appropriately adjusted.

It will be noted that in the scroll compressor 100, instead of forming the accommodation groove 33 in the floating member 30, the accommodation groove, which accommodates the first seal member 61, may be formed in the surface of the housing 40 that is orthogonal to the moving direction of the floating member 30.

(4-4)

In the scroll compressor 100 of the present embodiment, the first seal member 61 includes the U-seal 61*a* and the plate spring 61*b*. The plate spring 61*b* urges the U-seal 61*a* to the floating member 30 in such a way as to widen the U-seal 61*a*.

In the scroll compressor 100 of the present embodiment, the movable scroll 22 can be pushed against the fixed scroll 21 a certain extent even in a case where the pressure in the back-pressure space B is low, such as just after operation starts. For that reason, defects in the startup of the scroll compressor 100 can be prevented from being caused by refrigerant leakage from the tips of the wraps of the scrolls.

(4-5)

In the scroll compressor 100 of the present embodiment, the first seal member 61 seals the flow of the refrigerant from the second chamber B2 to the first chamber B1 but does not seal the flow of the refrigerant from the first chamber B1 to the second chamber B2.

In the scroll compressor 100, normally, the pressure of the refrigerant discharged from the compression mechanism 20 is higher than the pressure of the refrigerant in the middle of compression. In other words, normally, the pressure in the second chamber B2 is higher than the pressure in the first chamber B1. However, in some operating conditions, there are cases where these pressures reverse so that the pressure in the first chamber B1 becomes higher than the pressure in the second chamber B2.

In such cases, in the scroll compressor 100 of the present embodiment, the pressure in the compression chamber Sc in the middle of compression can be released, via the first chamber B1 and the second chamber B2, to the space (the second space S2) into which the refrigerant discharged from the compression mechanism 20 flows. Therefore, instances such as excessive pressure acts on the compression mechanism 20 due to liquid compression or other reasons and instances such as pushing force of the movable scroll 22 against the fixed scroll 21 becomes excessive due to an increase in the pressure in the back-pressure space B can be prevented.

(4-6)

The scroll compressor 100 of the present embodiment has the second seal member 62 and the third seal member 63. The second seal member 62 is disposed between the floating member 30 and the housing 40 and seals between the first chamber B1 and the first space S1. The third seal member 63 is disposed between the floating member 30 and the housing 40 and seals between the second chamber B2 and the first space S1.

In the scroll compressor 100 of the present embodiment, it is easy to reliably seal between the back-pressure space B and the first space S1.

(5) Example Modifications

Example modifications of the above embodiment will be described below. It will be noted that the following example modifications may be appropriately combined to the extent that they do not conflict with each other.

(5-1) Example Modification A

In the scroll compressor 100 of the above embodiment, the first seal member 61 is an annular gasket with a U-shaped cross section, but the first seal member 61 is not limited to this. For example, a seal ring having an abutment joint may be used for the first seal member 61 instead of a gasket with a U-shaped cross section.

Furthermore, in the scroll compressor 100, an annular O-ring with a circular cross section may be used as the first seal member 61. However, in a case where an O-ring is used as the first seal member 61, the first seal member 61 may be disposed between the outer peripheral surface of the floating member 30 and the inner peripheral surface of the housing 40 like the second seal member 62 and the third seal member 63 of the above embodiment. For that reason, the shapes of the floating member 30 and the housing 40 tend to be complicated. Therefore, it is preferred that a type of gasket that can be disposed in the surface of the floating member 30 or the housing 40 that is orthogonal to the moving direction of the floating member 30 be used for the first seal member 61.

(5-2) Example Modification B

In the scroll compressor 100 of the above embodiment, the first chamber B1 is disposed on the outer side of the second chamber B2, but the scroll compressor 100 is not limited to this. The second chamber B2 may be disposed on the outer side of the first chamber B1. However, from the standpoint of pushing the movable scroll 22 against the fixed scroll 21 with appropriate force, it is preferred that the second chamber B2 be disposed on the inner side of the first chamber B1.

(5-3) Example Modification C

In the scroll compressor 100 of the above embodiment, as seen in a plan view, the area of the first chamber B1 is greater than the area of the second chamber B2, but the scroll compressor 100 is not limited to this. As seen in a plan view, the area of the second chamber B2 may be greater than the area of the first chamber B1. However, from the standpoint of preventing the force with which the movable scroll 22 is pushed against the fixed scroll 21 from becoming excessive, it is preferred that the area of the first chamber B1 be greater than the area of the second chamber B2.

(5-4) Example Modification D

The scroll compressor 100 of the above embodiment is a vertical scroll compressor in which the drive shaft 80 extends in the vertical direction, but the scroll compressor 100 is not limited to this. The configuration of this invention is also applicable to a horizontal scroll compressor in which the drive shaft of the scroll compressor extends in the horizontal direction.

(5-5) Example Modification E

In the scroll compressor 100 of the above embodiment, the second seal member 62 and the third seal member 63 are O-rings, but they are not limited to this. For example, instead of O-rings, annular gaskets with U-shaped cross sections that are the same as the one used for the first seal member 61 may be used for the second seal member 62 and the third seal member 63. In this case, the second seal member 62 and the third seal member 63 may be accommodated in accommodation grooves formed in the surface of the floating member 30 or the housing 40 that is orthogonal to the moving direction of the floating member 30 (the axial direction of the drive shaft 80).

INDUSTRIAL APPLICABILITY

The present invention is useful as a low-pressure dome-type scroll compressor that can realize high-efficiency operations in a wide range of operating conditions.

What is claimed is:

1. A scroll compressor comprising:

a compression mechanism having a fixed scroll and a movable scroll, the movable scroll together with the fixed scroll forming a compression chamber, and the compression mechanism being configured to discharge refrigerant compressed in the compression chamber;

a motor configured to drive the movable scroll to cause the movable scroll to revolve with respect to the fixed scroll;

a casing accommodating the compression mechanism and the motor, the casing having an inside is partitioned into a first space in which the motor is disposed and a second space into which the refrigerant discharged from the compression mechanism flows;

a housing accommodated inside the casing;

a floating member supported by the housing, the floating member being configured to be pushed toward the movable scroll by pressure in a back-pressure space, the back pressure space being formed between the floating member and the housing, and the back pressure space being configured to push the movable scroll against the fixed scroll;

a first seal member partitioning the back-pressure space into a first chamber and a second chamber;

a first flow passage formed in the housing, and the first flow passage being configured to guide the refrigerant in the middle of compression in the compression mechanism to the first chamber; and a second flow passage formed in the housing, and the second flow passage being configured to guide the refrigerant discharged from the compression mechanism to the second chamber, a pressure in the back-pressure space being higher than a pressure in the first space during operation of the scroll compressor.

2. The scroll compressor according to claim 1, wherein dimensions of the first seal member are configured to change following movement of the floating member.

3. The scroll compressor according to claim 2, wherein an accommodation groove is formed in a surface of the floating member or the housing, the surface is orthogonal to a moving direction of the floating member, and the accommodating groove accommodates the first seal member.

4. The scroll compressor according to claim 3, wherein the first seal member includes a U-seal and a plate spring, and the plate spring is configured to urge the U-seal toward the floating member in such a way as to widen the U-seal.

5. The scroll compressor according to claim 1, wherein the first seal member seals flow of the refrigerant from the second chamber to the first chamber, and the first seal member does not seal flow of the refrigerant from the first chamber to the second chamber.

6. The scroll compressor according to claim 1, further comprising:

a second seal member disposed between the floating member and the housing, the second seal member being configured to seal between the first chamber and the first space; and a third seal member disposed between the floating member and the housing, the third seal member being configured to seal between the second chamber and the first space.

7. The scroll compressor according to claim 2, wherein the first seal member seals flow of the refrigerant from the second chamber to the first chamber, and the first seal member does not seal flow of the refrigerant from the first chamber to the second chamber.

8. The scroll compressor according to claim 2, further comprising:

a second seal member disposed between the floating member and the housing, the second seal member being configured to seal between the first chamber and the first space; and a third seal member disposed between the floating member and the housing, the third seal member being configured to seal between the second chamber and the first space.

9. The scroll compressor according to claim 3, wherein the first seal member seals flow of the refrigerant from the second chamber to the first chamber, and the first seal member does not seal flow of the refrigerant from the first chamber to the second chamber.

10. The scroll compressor according to claim 3, further comprising:

a second seal member disposed between the floating member and the housing, the second seal member being configured to seal between the first chamber and the first space; and a third seal member disposed between the floating member and the housing, the third seal member being configured to seal between the second chamber and the first space.

11. The scroll compressor according to claim 4, wherein the first seal member seals flow of the refrigerant from the second chamber to the first chamber, and the first seal member does not seal flow of the refrigerant from the first chamber to the second chamber.

12. The scroll compressor according to claim 4, further comprising:

a second seal member disposed between the floating member and the housing, the second seal member being configured to seal between the first chamber and the first space; and a third seal member disposed between the floating member and the housing, the third seal member being configured to seal between the second chamber and the first space.

13. The scroll compressor according to claim 5, further comprising:

a second seal member disposed between the floating member and the housing, the second seal member being configured to seal between the first chamber and the first space; and a third seal member disposed between the floating member and the housing, the third seal member being configured to seal between the second chamber and the first space.

* * * * *